US010772349B2

(12) United States Patent
Beeson et al.

(10) Patent No.: US 10,772,349 B2
(45) **Date of Patent: *Sep. 15, 2020**

(54) WHITENED TOBACCO COMPOSTION

(71) Applicant: R.J. Reynolds Tobacco Company, Winston-Salem, NC (US)

(72) Inventors: Dwayne William Beeson, Kernersville, NC (US); Jack Gray Flinchum, Jr., Clemmons, NC (US); Huamin Gan, Clemmons, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 627 days.

This patent is subject to a terminal disclaimer.

(21) Appl. No.: 15/230,976

(22) Filed: Aug. 8, 2016

(65) Prior Publication Data

US 2016/0338403 A1 Nov. 24, 2016

Related U.S. Application Data

(63) Continuation of application No. 13/372,120, filed on Feb. 13, 2012, now Pat. No. 9,420,825.

(51) Int. Cl.
*A24B 15/24* (2006.01)
*A24B 15/28* (2006.01)
(Continued)

(52) U.S. Cl.
CPC ..... *A24B 15/245* (2013.01); *A24B 15/24* (2013.01); *A24B 15/246* (2013.01);
(Continued)

(58) Field of Classification Search
CPC ..... A24B 15/24; A24B 13/00
See application file for complete search history.

(56) References Cited

U.S. PATENT DOCUMENTS 787,611 A 4/1905 Daniels, Jr.
1,086,306 A 2/1914 Oelenheinz
(Continued)

FOREIGN PATENT DOCUMENTS

BR PI1106360 11/2013
CA 2183825 2/1997
(Continued)

*Primary Examiner* — Michael H. Wilson
*Assistant Examiner* — Dionne W. Mayes
(74) *Attorney, Agent, or Firm* — Womble Bond Dickinson (US) LLP

(57) ABSTRACT

A method of preparing a whitened tobacco material is provided, the method including the steps of (i) extracting a tobacco material with an aqueous solution to give a tobacco pulp and a tobacco extract; (ii) treating the tobacco pulp with at least one of a caustic reagent and an oxidizing agent for a time and at a temperature sufficient to lighten the color of the tobacco pulp to give a whitened tobacco pulp; (iii) clarifying the tobacco extract to remove higher molecular weight components; and (iv) combining the whitened tobacco pulp with a clarified tobacco extract to form a whitened tobacco material. The whitened tobacco material can be isolated and incorporated into a smokeless tobacco product. The invention also provides a smokeless tobacco product incorporating a whitened tobacco material. The smokeless tobacco product may be a snus-type formulation contained within a sealed pouch.

21 Claims, 2 Drawing Sheets

(51) Int. Cl.
*A24B 15/32* (2006.01)
*A24F 23/02* (2006.01)
*B65D 65/38* (2006.01)

(52) U.S. Cl.
CPC ..... *A24B 15/287* (2013.01); *A24B 15/32* (2013.01); *A24F 23/02* (2013.01); *B65D 65/38* (2013.01)

(56) References Cited

U.S. PATENT DOCUMENTS

| | | | | |
|---|---|---|---|---|
| 1,437,095 | A | 11/1922 | Delling | |
| 1,757,477 | A | 5/1930 | Rosenhoch | |
| 1,847,162 | A | 3/1932 | Andrews | |
| 2,122,421 | A | 7/1938 | Hawkinson | |
| 2,131,160 | A | 9/1938 | Avedikian | |
| 2,148,147 | A | 2/1939 | Baier | |
| 2,170,107 | A | 8/1939 | Baier | |
| 2,274,649 | A | 3/1942 | Baier | |
| 2,270,239 | A | 11/1956 | Prats et al. | |
| 3,020,179 | A | 2/1962 | Hess | |
| 3,361,139 | A | 1/1968 | Inoue | |
| 3,612,065 | A | 10/1971 | Rosen | |
| 3,851,653 | A | 12/1974 | Rosen | |
| 3,889,689 | A | 6/1975 | Rosen | |
| 3,943,940 | A | 3/1976 | Minami | |
| 3,943,945 | A | 3/1976 | Rosen | |
| 4,143,666 | A | 3/1979 | Rainer et al. | |
| 4,144,895 | A | 3/1979 | Fiore | |
| 4,150,677 | A | 4/1979 | Osborne, Jr. et al. | |
| 4,194,514 | A | 3/1980 | Campbell | |
| 4,267,847 | A | 5/1981 | Reid | |
| 4,289,147 | A | 9/1981 | Wildman et al. | |
| 4,343,317 | A | 8/1982 | Bokelman | |
| 4,351,346 | A | 9/1982 | Brummer et al. | |
| 4,355,648 | A | 10/1982 | Bokelman et al. | |
| 4,359,059 | A | 11/1982 | Brummer et al. | |
| 4,362,170 | A | 12/1982 | Keritsis et al. | |
| 4,366,823 | A | 1/1983 | Rainer et al. | |
| 4,366,824 | A | 1/1983 | Rainer et al. | |
| 4,388,933 | A | 6/1983 | Rainer et al. | |
| 4,506,682 | A | 3/1985 | Muller | |
| 4,589,428 | A | 5/1986 | Keritsis | |
| 4,605,016 | A | 8/1986 | Soga et al. | |
| 4,641,667 | A | 2/1987 | Schmekel et al. | |
| 4,716,911 | A | 1/1988 | Poulose et al. | |
| 4,727,888 | A * | 3/1988 | Luke ..... | A24D 1/00 131/360 |
| 4,727,889 | A | 3/1988 | Niven, Jr. et al. | |
| 4,887,618 | A | 12/1989 | Bernasek et al. | |
| 4,941,484 | A | 7/1990 | Clapp et al. | |
| 4,967,771 | A | 11/1990 | Fagg et al. | |
| 4,986,286 | A | 1/1991 | Roberts et al. | |
| 5,005,593 | A | 4/1991 | Fagg | |
| 5,018,540 | A | 5/1991 | Grubbs et al. | |
| 5,060,669 | A | 10/1991 | White et al. | |
| 5,065,775 | A | 11/1991 | Fagg | |
| 5,074,319 | A | 12/1991 | White et al. | |
| 5,099,862 | A | 3/1992 | White et al. | |
| 5,121,757 | A | 6/1992 | White et al. | |
| 5,131,414 | A | 7/1992 | Fagg et al. | |
| 5,131,415 | A | 7/1992 | Munoz et al. | |
| 5,148,819 | A | 9/1992 | Fagg | |
| 5,197,494 | A | 3/1993 | Kramer | |
| 5,230,354 | A | 7/1993 | Smith et al. | |
| 5,234,008 | A | 8/1993 | Fagg | |
| 5,243,999 | A | 9/1993 | Smith | |
| 5,301,694 | A | 4/1994 | Raymond et al. | |
| 5,318,050 | A | 6/1994 | Gonzalez-Parra et al. | |
| 5,343,879 | A | 9/1994 | Teague | |
| 5,360,022 | A | 11/1994 | Newton et al. | |
| 5,435,325 | A | 7/1995 | Clapp et al. | |
| 5,445,169 | A | 8/1995 | Brinkley et al. | |
| 5,713,376 | A | 2/1998 | Berger | |
| 5,810,020 | A | 9/1998 | Northway et al. | |
| 6,058,940 | A | 5/2000 | Lane | |
| 6,131,584 | A | 10/2000 | Lauterbach | |
| 6,298,859 | B1 | 10/2001 | Kierulff et al. | |
| 6,679,270 | B2 | 1/2004 | Baskevitch et al. | |
| 6,772,767 | B2 | 8/2004 | Mua et al. | |
| 7,337,782 | B2 | 3/2008 | Thompson | |
| 7,677,253 | B2 | 3/2010 | Yamada et al. | |
| 9,420,825 | B2 * | 8/2016 | Beeson et al. ..... | A24B 15/24 |
| 2002/0134394 | A1 | 9/2002 | Baskevitch et al. | |
| 2008/0178894 | A1 | 7/2008 | Zimmermann | |
| 2009/0126747 | A1 | 5/2009 | L'Heureux et al. | |
| 2010/0126520 | A1 | 5/2010 | Clayton | |
| 2010/0294292 | A1 * | 11/2010 | Hodin ..... | A24B 13/00 131/359 |
| 2011/0083683 | A1 | 4/2011 | Krauss | |
| 2011/0247640 | A1 | 10/2011 | Beeson et al. | |
| 2012/0067361 | A1 | 3/2012 | Björkholm et al. | |
| 2013/0276801 | A1 | 10/2013 | Byrd, Jr. et al. | |
| 2014/0190497 | A1 | 7/2014 | Dube et al. | |
| 2015/0305399 | A1 | 10/2015 | Kotrola et al. | |
| 2017/0020183 | A1 | 1/2017 | Björkholm | |

FOREIGN PATENT DOCUMENTS

| | | |
|---|---|---|
| CN | 1477935 | 2/2004 |
| CN | 102943408 | 2/2013 |
| CN | 105725255 | 7/2016 |
| CN | 106942783 | 7/2017 |
| DE | 467964 | 11/1928 |
| DE | 635840 | 12/1936 |
| DE | 662320 | 7/1938 |
| DE | 671126 | 1/1939 |
| DE | 686442 | 1/1940 |
| DE | 3736335 | 5/1989 |
| DE | 29506564 | 6/1995 |
| FR | 379963 | 11/1907 |
| GB | 190312646 | 8/1903 |
| GB | 832991 | 4/1960 |
| GB | 884435 | 12/1961 |
| GB | 2 113 065 | 8/1983 |
| NL | 7810833 | 5/1980 |
| WO | WO 96-31255 | 10/1996 |
| WO | WO 2009/068279 | 6/2009 |
| WO | WO 2015/167430 | 11/2015 |
| WO | WO 2016/067226 | 5/2016 |

* cited by examiner

WHITENED TOBACCO COMPOSTION

CROSS-REFERENCE TO RELATED APPLICATIONS

The present application is a continuation of U.S. application Ser. No. 13/372,120 filed Feb. 13, 2012, which is incorporated by reference herein in its entirety.

FIELD OF THE INVENTION

The present invention relates to products made or derived from tobacco, or that otherwise incorporate tobacco, and are intended for human consumption.

BACKGROUND OF THE INVENTION

Cigarettes, cigars and pipes are popular smoking articles that employ tobacco in various forms. Such smoking articles are used by heating or burning tobacco, and aerosol (e.g., smoke) is inhaled by the smoker. Tobacco also may be enjoyed in a so-called "smokeless" form. Particularly popular smokeless tobacco products are employed by inserting some form of processed tobacco or tobacco-containing formulation into the mouth of the user.

Various types of smokeless tobacco products are known. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; 2010/0291245 to Gao et al; and 2011/0139164 to Mua et al.; PCT WO 04/095959 to Arnarp et al. and WO 2010/132444 to Atchley; each of which is incorporated herein by reference.

One type of smokeless tobacco product is referred to as "snuff." Representative types of moist snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. are marketed under the tradenames CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard.

Through the years, various treatment methods and additives have been proposed for altering the overall character or nature of tobacco materials utilized in tobacco compositions. For example, additives or treatment processes are sometimes utilized in order to alter the chemistry or sensory properties of the tobacco material, or in the case of smokable tobacco materials, to alter the chemistry or sensory properties of mainstream smoke generated by smoking articles including the tobacco material. In some cases, a heat treatment process can be used to impart a desired color or visual character to the tobacco material, desired sensory properties to the tobacco material, or a desired physical nature or texture to the tobacco material.

It would be desirable in the art to provide further methods for altering the character and nature of tobacco (and tobacco compositions and formulations) useful in smoking articles or smokeless tobacco products.

SUMMARY OF THE INVENTION

The present invention provides a method of processing a tobacco material to modify the color of the tobacco material, specifically to provide a tobacco pulp material that is lightened in color (i.e., "whitened") and/or a tobacco extract that is clarified. The whitened tobacco pulp and a clarified extract can be used in smokeless tobacco materials to give materials with a whitened appearance.

Accordingly, in one aspect of the invention is provided a method of whitening a tobacco material for use in a smokeless tobacco product, comprising: (i) extracting a tobacco material with an aqueous solution to give a tobacco pulp and a tobacco extract; (ii) treating the tobacco pulp with at least one of a caustic reagent and an oxidizing agent for a time and at a temperature sufficient to lighten the color of the tobacco pulp to give a whitened tobacco pulp; (iii) clarifying the tobacco extract to remove higher molecular weight components and to give a clarified tobacco extract; and (iv) combining the whitened tobacco pulp with a clarified tobacco extract to form a whitened tobacco material. In certain embodiments, the whitened tobacco pulp and tobacco extract combined in step (iv) are derived from the same tobacco material. In other embodiments, the whitened tobacco pulp and tobacco extract combined in step (iv) are derived from different tobacco materials.

The caustic reagent and oxidizing agent can vary. For example, in certain embodiments, the caustic reagent is sodium hydroxide. In certain embodiments, the oxidizing agent is hydrogen peroxide. In embodiments wherein both a caustic reagent and an oxidizing agent are used, the ratio of the caustic reagent to oxidizing agent can vary. For example, the molar ratio of the amount of caustic reagent to the amount of oxidizing agent can be from about 1:1 to about 1:100, for example, about 1:5 to about 1:50 or about 1:20 to about 1:25.

The method of whitening can further comprise selecting the tobacco material to be extracted in step (i) by visually inspecting a group of tobacco materials and selecting the tobacco material that it is relatively light in color as compared with the remainder of tobacco material in the group. The tobacco material can comprise, for example, tobacco lamina and stems. Various types of tobacco can be used, including, but not limited to, sun-cured milled stems (*Rustica*) and sun-cured and dark air-cured lamina & stems and light air-cured stems (burley stems).

In some embodiments, the treating step is conducted at room temperature. In certain embodiments, the treating step further comprises heating the mixture of tobacco pulp, caustic reagent, and oxidizing agent at a temperature sufficient to increase the rate of whitening. The temperature can vary, and in some embodiments does not exceed about 72° C. The clarified tobacco extract can be, in some embodiments, characterized as translucent or transparent. In certain embodiments, the treating step comprises distilling (i.e., steam processing) or filtering the tobacco extract. The filtering can, for example, comprise passing the tobacco extract through a membrane filter having a cutoff molecular weight of 1000 Da. In some embodiments, the filtering can comprise passing the tobacco extract through a series of one or more filtration membranes having cutoff molecular weights of from about 10,000 Da to about 1,000,000 Da. In certain embodiments, the clarified tobacco extract can be characterized by a low tobacco-specific nitrosamine content (e.g., about 150 ng/g or less) and/or a low benzo[a]pyrene content (e.g., about 1 ng/g or less), based on the weight of the clarified extract.

The ratio of whitened tobacco pulp to tobacco extract combined in step (iv) can vary. For example, in certain embodiments, the weight ratio of whitened pulp to tobacco extract is between about 90:1 and about 1:1. The ratio may depend on the nature of the tobacco extract given by step (i). Thus, in certain embodiments, the ratio of whitened tobacco pulp to tobacco extract can depend on the method of extract clarification used. For example, more extract may be used in embodiments wherein the extract is clarified by filtration, whereas less extract may be used in embodiments wherein the extract is clarified by distillation. In certain embodiments, the weight ratio (by dry weight basis) of whitened pulp to filtered tobacco extract is between about 1:1 and about 10:1 (e.g., between about 1.5:1 and about 3:1). In certain embodiments, the weight ratio of whitened pulp to distilled tobacco extract is between about 10:1 and about 90:1. In some embodiments, the amount of extract is adjusted so as to achieve a desired amount of tobacco components and/or moisture content in the final product.

In some embodiments, the whitened tobacco material can be incorporated within a smokeless tobacco product. In addition to the whitened tobacco material thus produced, the smokeless tobacco product further comprises one or more additional components selected from the group consisting of flavorants, fillers, binders, pH adjusters, buffering agents, colorants, disintegration aids, antioxidants, humectants, and preservatives.

In another aspect of the invention is provided a smokeless tobacco product prepared according to the methods described herein. In certain embodiments, the invention provides a smokeless tobacco product comprising a whitened tobacco composition, the whitened tobacco composition comprising a clarified tobacco extract carried by a whitened tobacco pulp. The smokeless tobacco product can, in some embodiments, comprise a clarified tobacco extract in the form of a distillate or a filtered tobacco extract. The clarified tobacco extract may be, for example, an extract that does not comprise any components having a molecular weight greater than about 1000 Da. The clarified extract can, in certain embodiments, be characterized as translucent or transparent.

The form of the smokeless tobacco product of the invention can vary. In certain embodiments, the smokeless tobacco product comprises a water-permeable pouch containing the clarified tobacco extract carried by a whitened tobacco pulp. The smokeless tobacco product may comprise one or more additional components, such as those selected from the group consisting of flavorants, fillers, binders, pH adjusters, buffering agents, colorants, disintegration aids, antioxidants, humectants, and preservatives. For example, in one specific embodiment, the smokeless tobacco product comprises about 80% to about 95% whitened tobacco composition; about 0.1% to about 5% artificial sweetener; about 0.5% to about 2% salt; about 1% to about 5% flavoring; and about 1% to about 5% humectant. One exemplary humectant is propylene glycol.

DETAILED DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

Certain embodiments of the invention will be described with reference to FIG. 1 of the accompanying drawings, and these described embodiments involve snus-type products having an outer pouch and containing a whitened tobacco material within the tobacco formulation. As explained in greater detail below, such embodiments are exemplary only, and the smokeless tobacco product can include tobacco compositions in other forms.

Figure 1:
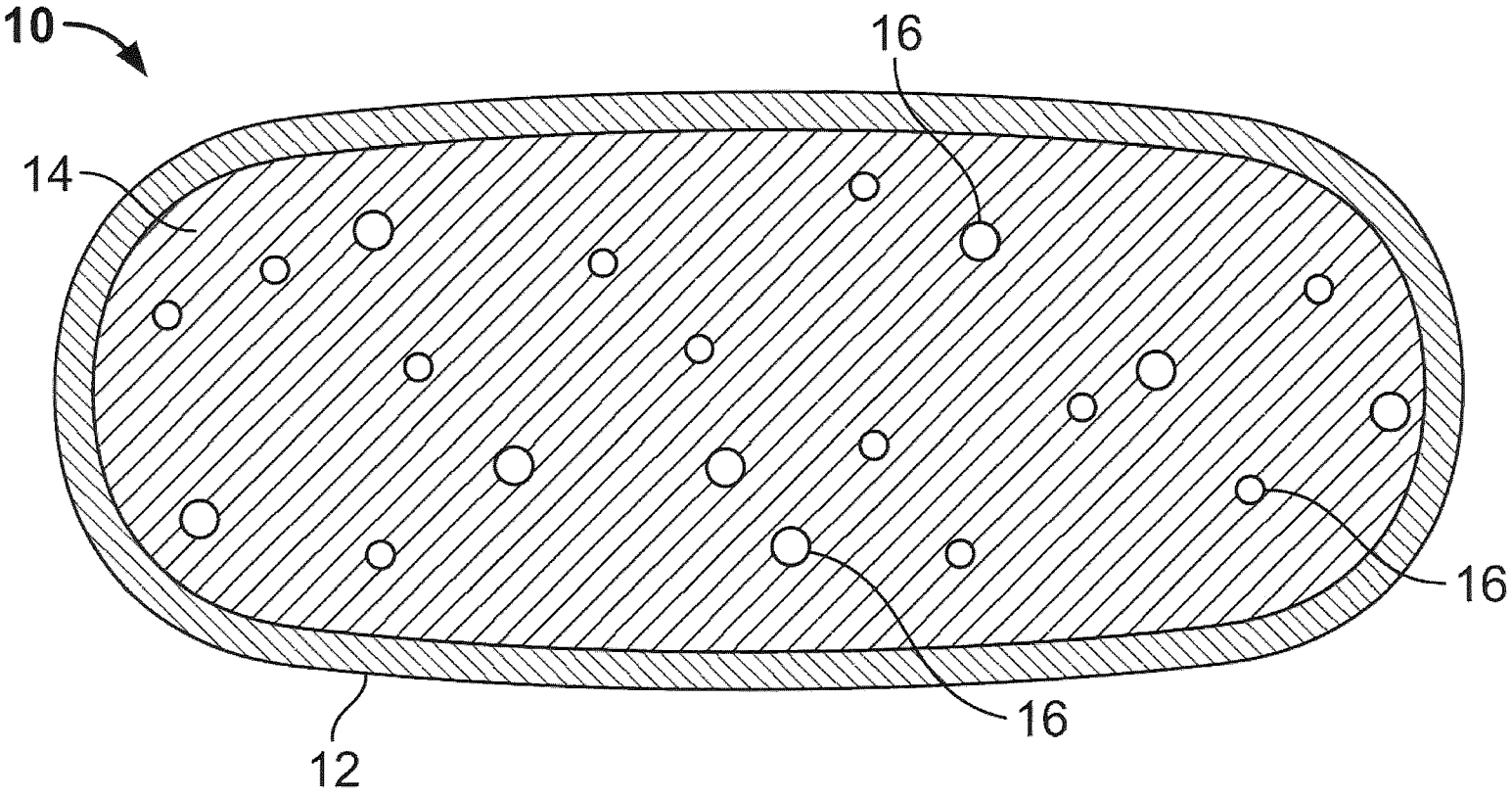
FIG. 1 is a cross-sectional view of a smokeless tobacco product embodiment, taken across the width of the product, showing an outer pouch filled with tobacco material and optional microcapsules disposed in the tobacco material.

Referring to FIG. 1, there is shown a first embodiment of a smokeless tobacco product 10. The tobacco product 10 includes a moisture-permeable container in the form of a pouch 12, which contains a solid tobacco filler material 14 comprising a whitened tobacco material of a type described herein. The smokeless tobacco product also may optionally comprise, in certain embodiments, a plurality of microcapsules 16 dispersed within the tobacco filler material 14, the microcapsules containing a component (e.g., a flavorant) such as described in greater detail below.

The tobacco product 10 is typically used by placing one pouch containing the tobacco formulation in the mouth of a human subject/user. During use, saliva in the mouth of the user causes some of the components of the tobacco formulation to pass through the water-permeable pouch and into the mouth of the user. The pouch preferably is not chewed or swallowed. The user is provided with tobacco flavor and satisfaction, and is not required to spit out any portion of the tobacco formulation. After about 10 minutes to about 60 minutes, typically about 15 minutes to about 45 minutes, of use/enjoyment, substantial amounts of the tobacco formulation and the contents of the optional microcapsules and have been ingested by the human subject, and the pouch may be removed from the mouth of the human subject for disposal.

The invention provides a whitened tobacco composition, smokeless tobacco products incorporating such whitened tobacco compositions, and methods for preparing a whitened tobacco composition and for incorporating such compositions within smokeless tobacco products. As used herein, the term "whitened" refers to a composition comprising a tobacco material that has been treated to remove some degree of color therefrom. Thus, a "whitened" tobacco material that is treated according to the methods described herein is visually lighter in hue than an untreated tobacco material. The whitened tobacco composition of the invention can be used as a component of a smokeless tobacco composition, such as loose moist snuff, loose dry snuff, chewing tobacco, pelletized tobacco pieces, extruded or formed tobacco strips, pieces, rods, or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips, or capsule-like materials.

Tobaccos used in the tobacco compositions of the invention may vary. In certain embodiments, tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and *Galpao* tobaccos), Indian air cured, Red Russian and *Rustica* tobaccos, as well as various other rare or specialty tobaccos and various blends of any of the foregoing tobaccos. Descriptions of various types of tobaccos, growing practices and harvesting practices are set forth in *Tobacco Production, Chemistry and Technology*, Davis et al. (Eds.) (1999), which is incorporated herein by reference. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference. Exemplary *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N. x sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia*, and *N. spegazzinii.*

*Nicotiana* species can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO 2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference. Most preferably, the tobacco materials are those that have been appropriately cured and aged. Especially preferred techniques and conditions for curing flue-cured tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference. Certain types of unusual or rare tobaccos can be sun cured. Manners and methods for improving the smoking quality of Oriental tobaccos are set forth in U.S. Pat. No. 7,025,066 to Lawson et al., which is incorporated herein by reference. Representative Oriental tobaccos include katerini, prelip, komotini, xanthi and yambol tobaccos. Tobacco compositions including dark air cured tobacco are set forth in US Patent Appl. Pub. No. 2008/0245377 to Marshall et al., which is incorporated herein by reference. See also, types of tobacco as set forth, for example, in US Patent Appl. Pub. No. 2011/0247640 to Beeson et al., which is incorporated herein by reference.

The *Nicotiana* species can be selected for the content of various compounds that are present therein. For example, plants can be selected on the basis that those plants produce relatively high quantities of one or more of the compounds desired to be isolated therefrom. In certain embodiments, plants of the *Nicotiana* species (e.g., *Galpao commun* tobacco) are specifically grown for their abundance of leaf surface compounds. Tobacco plants can be grown in greenhouses, growth chambers, or outdoors in fields, or grown hydroponically.

Various parts or portions of the plant of the *Nicotiana* species can be employed. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment. In some embodiments, the tobacco material subjected to the treatments set forth herein is *Rustica* stems in milled form.

The post-harvest processing of the plant or portion thereof can vary. After harvest, the plant, or portion thereof, can be used in a green form (e.g., the plant or portion thereof can be used without being subjected to any curing process). For example, the plant or portion thereof can be used without being subjected to significant storage, handling or processing conditions. In certain situations, it is advantageous for the plant or portion thereof be used virtually immediately after harvest. Alternatively, for example, a plant or portion thereof in green form can be refrigerated or frozen for later use, freeze dried, subjected to irradiation, yellowed, dried, cured (e.g., using air drying techniques or techniques that employ application of heat), heated or cooked (e.g., roasted, fried or boiled), or otherwise subjected to storage or treatment for later use.

The harvested plant or portion thereof can be physically processed. The plant or portion thereof can be separated into individual parts or pieces (e.g., the leaves can be removed from the stems, and/or the stems and leaves can be removed from the stalk). The harvested plant or individual parts or pieces can be further subdivided into parts or pieces (e.g., the leaves can be shredded, cut, comminuted, pulverized, milled or ground into pieces or parts that can be characterized as filler-type pieces, granules, particulates or fine powders). The plant, or parts thereof, can be subjected to external forces or pressure (e.g., by being pressed or subjected to roll treatment). When carrying out such processing conditions, the plant or portion thereof can have a moisture content that approximates its natural moisture content (e.g., its moisture content immediately upon harvest), a moisture content achieved by adding moisture to the plant or portion thereof, or a moisture content that results from the drying of the plant or portion thereof. For example, powdered, pulverized, ground or milled pieces of plants or portions thereof can have moisture contents of less than about 25 weight percent, often less than about 20 weight percent, and frequently less than about 15 weight percent.

Tobacco compositions intended to be used in a smokeless form such as that in FIG. 1 may incorporate a single type of tobacco (e.g., in a so-called "straight grade" form). For example, the tobacco within a tobacco composition may be composed solely of flue-cured tobacco (e.g., all of the tobacco may be composed, or derived from, either flue-cured tobacco lamina or a mixture of flue-cured tobacco lamina and flue-cured tobacco stem). In one embodiment, the tobacco comprises or is composed solely of sun-cured milled *Rustica* stems. The tobacco within a tobacco composition also may have a so-called "blended" form. For example, the tobacco within a tobacco composition of the present invention may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other exemplary tobacco blends incorporate about 75 parts flue-cured tobacco, about 15 parts burley tobacco, and about 10 parts Oriental tobacco; or about 65 parts flue-cured tobacco, about 25 parts burley tobacco, and about 10 parts Oriental tobacco; or about 65 parts flue-cured tobacco, about 10 parts burley tobacco, and about 25 parts Oriental tobacco; on a dry weight basis. Other exemplary tobacco blends incorporate about 20 to about 30 parts Oriental tobacco and about 70 to about 80 parts flue-cured tobacco.

The tobacco material can have the form of processed tobacco parts or pieces, cured and aged tobacco in essentially natural lamina and/or stem form, a tobacco extract, extracted tobacco pulp (e.g., using water as a solvent), or a mixture of the foregoing (e.g., a mixture that combines extracted tobacco pulp with granulated cured and aged natural tobacco lamina). The tobacco that is used for the tobacco product most preferably includes tobacco lamina, or a tobacco lamina and stem mixture. Portions of the tobaccos within the tobacco product may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and U.S. Pat. No. 7,556,047 to Poindexter, et al., all of which are incorporated by reference. In addition, the tobacco product optionally may incorporate tobacco that has been fermented. See, also, the types of tobacco processing techniques set forth in PCT WO 05/063060 to Atchley et al., which is incorporated herein by reference.

The tobacco material used in the present invention is typically provided in a shredded, ground, granulated, fine particulate, or powder form. Most preferably, the tobacco is employed in the form of parts or pieces that have an average particle size less than that of the parts or pieces of shredded tobacco used in so-called "fine cut" tobacco products. Typically, the very finely divided tobacco particles or pieces are sized to pass through a screen of about 18 or 16 Tyler mesh, generally are sized to pass a screen of about 20 Tyler mesh, often are sized to pass through a screen of about 50 Tyler mesh, frequently are sized to pass through a screen of about 60 Tyler mesh, may even be sized to pass through a screen of 100 Tyler mesh, and further may be sized so as to pass through a screen of 200 Tyler mesh. If desired, air classification equipment may be used to ensure that small sized tobacco particles of the desired sizes, or range of sizes, may be collected. In one embodiment, the tobacco material is in particulate form sized to pass through an 18 or 16 Tyler mesh, but not through a 60 Tyler mesh. If desired, differently sized pieces of granulated tobacco may be mixed together. Typically, the very finely divided tobacco particles or pieces suitable for snus products have a particle size greater than −8 Tyler mesh, often −8 to +100 Tyler mesh, frequently −16 to +60 Tyler mesh. In certain embodiments, the tobacco is provided with an average particle size of about 0.3 to about 2 mm, more often about 0.5 to about 1.5 mm, and most often about 0.75 to about 1.25 mm (e.g., about 1 mm).

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent. The tobacco material can be processed to provide it in the desired form before and/or after being subjected to the whitening and/or clarification processes described herein.

In some embodiments, the type of tobacco material that is treated (i.e., subjected to the processes described herein, such as extraction, distillation, whitening, and/or clarification) is selected such that it is initially visually lighter in color than other tobacco materials to some degree. Accordingly, one optional step of the method described herein comprises screening various tobacco materials and selecting one or more of the tobacco materials based on their visual appearance (i.e., their "lightness," or "whiteness"). Where conducted, this screening step can, in some embodiments, comprise a visual screening wherein certain tobacco materials (e.g., certain tobacco types) are selected that are visually lighter in hue than other tobacco materials. In some embodiments, the screening can be conducted by means of an automated operation that selects certain tobacco materials based on predetermined characteristics (e.g., having a lightness above a given threshold value). For example, optical instruments (e.g., spectrophotometer/spectroreflectometer) and/or optical sorting equipment can be used for this purpose. Such equipment is available, for example, from Autoelrepho® Products, AZ Technology, Hunter Lab, X-Rite, SpecMetrix, and others.

In general, according to the present invention, the tobacco material is first treated in a manner so as to produce a tobacco extract and a residual tobacco pulp. As explained in greater detail below and illustrated in FIG. 2, this first treatment step can comprise a solvent extraction 22 comprising contacting the tobacco material with a solvent (e.g., water) for a time and at a temperature sufficient to cause the extraction of one or more components of the tobacco material into the solvent, and separating the extract from the residual tobacco pulp. The extract is then typically treated ("clarified") 26 in some way to provide a clarified tobacco extract. For example, the clarification can comprise filtering the extract through one or more filters to remove certain components, giving a clarified tobacco extract. Alternatively, the clarification can comprise a distillation process, comprising contacting the tobacco material with a solvent (e.g., water) and subjecting the mixture to a distillation process for a time and at a temperature sufficient to cause the distillation of one or more components of the tobacco material and to provide a clarified tobacco extract (i.e., distillate).

"Tobacco pulp" as used herein is the solid, residual tobacco material that remains after the liquid component (i.e., tobacco extract) is removed from the material in step 22. "Tobacco extract" as used herein refers to the isolated components of a tobacco material that are extracted from solid tobacco pulp by a solvent that is brought into contact with the tobacco material in an extraction process in step 22. "Clarified tobacco extract" refers to the components of a tobacco material that are isolated as a tobacco extract and collected following further treatment by filtration and/or by distillation in step 26.

Various extraction techniques of tobacco materials can be used to provide a tobacco extract and tobacco pulp. See, for example, the extraction processes described in US Pat. Appl. Pub. No. 2011/0247640 to Beeson et al., which is incorporated herein by reference. Other exemplary techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein. In certain embodiments, the solvent is added to the tobacco material and the material is soaked for a given period of time (e.g., about 1 h); the pulp is then filtered to give a tobacco pulp and the solvent and any solubles contained therein are filtered off to give a tobacco extract.

The solvent used for extraction of the tobacco material can vary. For example, in some embodiments, the solvent comprises a solvent having an aqueous character, such as distilled water and/or tap water. In some embodiments, the solvent can have one or more additives and may contain, for example, organic and/or inorganic acids, bases, or salts, pH buffers, surfactants, or combinations thereof and may comprise minor amounts of one or more organic solvents (e.g., various alcohols, polyols, and/or humectants). In one particular embodiment, the solvent comprises sodium hydroxide (NaOH) (e.g., as a 5% NaOH solution in water). In other embodiments, the solvent can comprise an organic solvent, such as an alcohol (e.g., ethanol, isopropanol, etc.), which can be used alone or in combination with an aqueous solvent. Typically, the extraction comprises adding a large excess of one or more solvents to the tobacco material so as to produce a slurry (comprising, for example, 50-90% by weight of the solvent), although the amount of solvent can vary. The solvent can be at room temperature or at an elevated temperature. For example, the solvent can be heated at a temperature of between about room temperature and about 120° C., preferably about room temperature and about 110° C. (e.g., about 100° C., about 80° C., about 60° C., about 40° C., or about 20° C.).

The amount of time for which the tobacco material remains in contact with the solvent can vary. For example, in some embodiments, the tobacco material is in contact with the solvent for about thirty minutes to about six hours (e.g., about 1 hour, about 2 hours, about 3 hours, about 4 hours, about 5 hours, or about 6 hours), although shorter and longer time periods can be used. The amount of time can depend, for example, on the temperature of the solvent. For example, less time may be required to extract the tobacco material using solvent at a higher temperature than that required to extract the tobacco material with room temperature or cold solvent. The extraction process provides a tobacco pulp and a tobacco extract.

The number of extraction steps can vary. For example, in certain embodiments, the tobacco pulp is extracted one or more times, two or more times, three or more times, four or more times, or five or more times. The solvent used for each extraction can vary. For example, in one particular embodiment, one or more extractions are conducted using hot water; and in a final extraction, the extraction is conducted using a basic solution (e.g., a 5% NaOH solution). After each extraction step, the pulp is filtered and the solvent and solubles are removed from the pulp. In certain embodiments, the extracts obtained from each extraction can be combined and clarified as provided herein. In other embodiments, some extracts are discarded, such as extracts from later stages. In such embodiments, for example, it may be desirable in some embodiments to use only the tobacco extract obtained from a first extraction of a tobacco material or to combine tobacco extracts obtained from a first and second extraction of a tobacco material.

Following the extraction process, the tobacco pulp is generally isolated from the tobacco extract, for example, by filtration or centrifugation, although these methods are not intended to be limiting. Alternatively, in some embodiments, the tobacco pulp can be isolated from the extract by means of distillation (e.g., steam distillation) of the tobacco mixture (e.g., the tobacco slurry).

It is desirable according to certain embodiments of the present invention to provide a tobacco extract that is sufficiently clarified. By "clarified" is meant that the extract is treated so as to remove certain high molecular weight compounds. The clarified extract is generally lighter in color (e.g., clearer) than unfiltered and/or undistilled extract. For example, in certain embodiments, the clarified extract can be described as translucent or transparent.

In certain embodiments, the filtration or distillation step of the extraction process provides an extract that can be characterized as clarified, without any further processing. For example, as noted above, in some embodiments, the tobacco extract is isolated from the tobacco pulp by means of distillation, which provides a distillate that is generally sufficiently clarified and in certain embodiments, is not subjected to any further clarification. Accordingly, such a distillate in certain embodiments of the invention is characterized as a "clarified extract." Similarly, in certain embodiments, the tobacco extract is isolated form the tobacco pulp by means of filtration, which may, in some embodiments, provide an extract that is sufficiently clarified. In such embodiments, the filtered tobacco extract is not subjected to any clarification and can be characterized as a "clarified extract."

Figure 2:
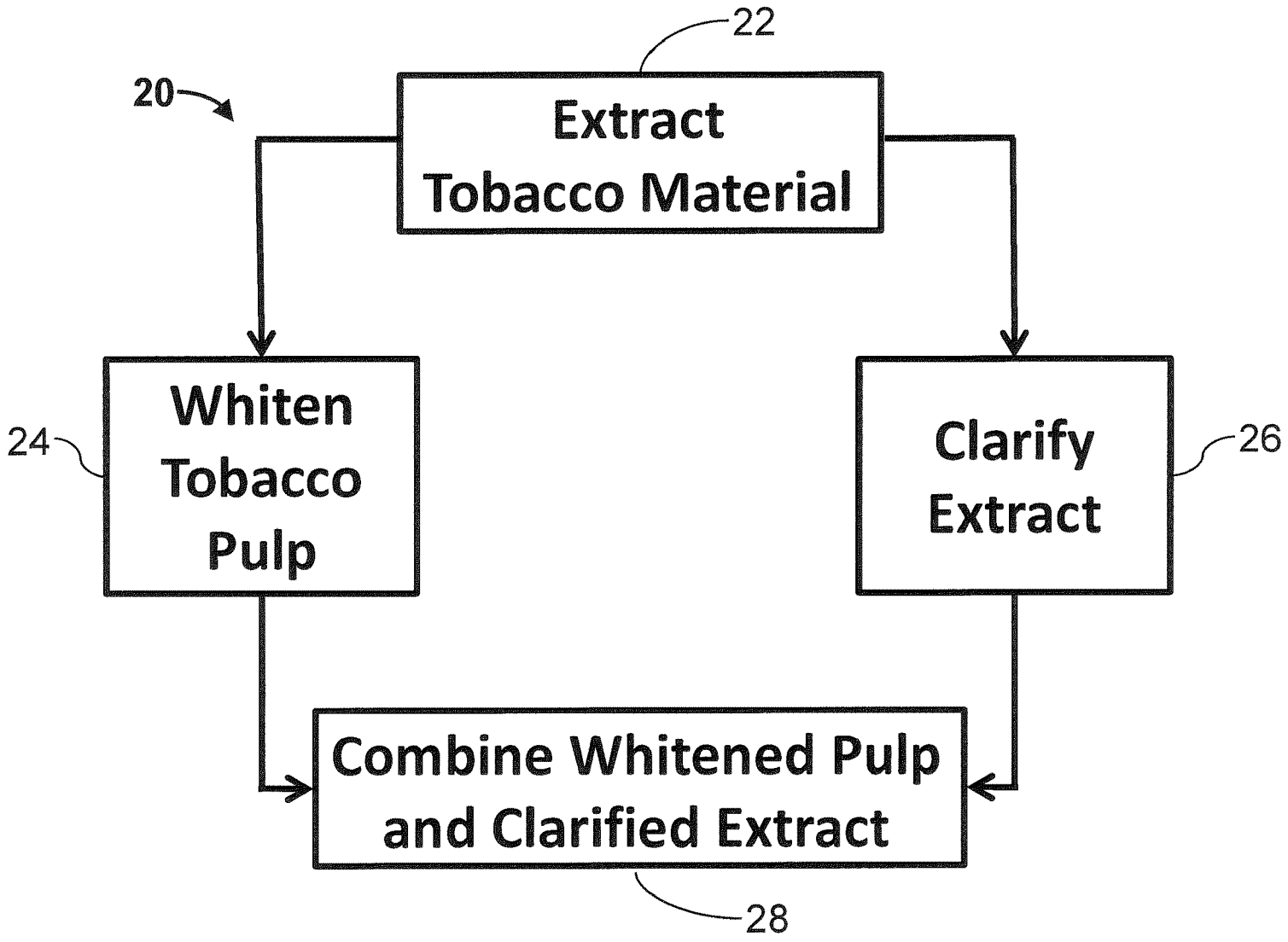
FIG. 2 is a schematic of a process involving extracting a tobacco component to provide a tobacco pulp and a tobacco extract, whitening the pulp, clarifying the extract, and recombining the whitened pulp and the clarified extract to give a whitened tobacco product.

However, in other embodiments, following separation of the tobacco pulp from the tobacco extract (e.g., by centrifugation and/or filtration), the extract is separately processed to give a clarified extract, as shown in FIG. 2. Clarification of a tobacco extract generally requires the removal and/or degradation of high molecular weight compounds. The means by which high molecular weight compounds are removed can vary.

For example, in some embodiments, the tobacco extract is distilled to provide a clarified tobacco extract. In certain embodiments, the distillation is achieved using one or more reagents that are added to the tobacco extract before and/or during the distillation. In one specific embodiment, water and a caustic reagent (e.g., NaOH or potassium hydroxide (KOH)) are brought into contact with the tobacco extract. The resulting mixture is heated at a temperature sufficient to cause certain volatile tobacco components to vaporize. The temperature of the distillation can vary, but is generally greater than room temperature. For example, the distillation can be conducted at greater than about 60° C., greater than about 70° C., greater than about 80° C., greater than about 90° C., or greater than about 100° C. The vaporized components are typically condensed and subsequently collected to give the clarified tobacco extract.

In some embodiments, the tobacco extract is filtered to provide a clarified tobacco extract. The filtration process can use any type of filter or filters capable of removing compounds from the extract. In certain embodiments, membrane filters are used to remove compounds having a number average molecular weight above a particular cutoff value. The number average molecular weight cutoff of the filters are in certain embodiments 50,000 Da, 5,000 Da, 1000 Da, 750 Da, and/or 250 Da, although many other ultrafiltration and nanofiltration filters are available and can be used without departing from the invention. In certain embodiments, a multistage filtration process is used to provide an extract with improved clarity. Such embodiments employ multiple filters and/or membranes of different (typically decreasing) molecular weight cutoffs. Any number of filters and/or membranes can be used in succession according to the invention.

In one embodiment, filtration (e.g., nanofiltration and/or ultrafiltration) is used to remove high molecular weight components in the tobacco extract to give a clarified tobacco extract. For example, in certain nanofiltration and ultrafiltration processes, the tobacco extract to be filtered is brought into contact with a semipermeable membrane. The membrane can be of any type, such as plate-and-frame (having a stack of membranes and support plates), spiral-wound (having consecutive layers of membrane and support material rolled up around a tube), tubular (having a membrane-defined core through which the feed flows and an outer, tubular housing where permeate is collected), or hollow fiber (having several small diameter tubes or fibers wherein the permeate is collected in the cartridge area surrounding the fibers). The membrane can be constructed of various materials. For example, polysulfone, polyethersulfone, polypropylene, polyvinylidenefluoride, and cellulose acetate membranes are commonly used, although other materials can be used without departing from the invention described herein.

Ultrafiltration membranes are available in a wide range of pore sizes (typically ranging from about 0.1 to about 0.001 microns). Membranes are more typically described by their molecular weight cutoffs. Ultrafiltration membranes are commonly classified as membranes with number average molecular weight cutoffs of from about $10^3$ Da to about $10^5$ Da. In practice, compounds with molecular weights above the molecular weight cutoff are retained in the retentate, and the compounds with molecular weights below the cutoff pass through the filter into the permeate. Ultrafiltration methods typically are not capable of removing low molecular weight organic compounds and ions. Nanofiltration is a filtration method wherein generally, the molecular weight cutoff of the filters is generally within the range of about 100 Da to about 1000 Da. In other words, nanofilters that allow only components of the tobacco extract having molecular weights below about 100 Da, below about 250 Da, below about 500 Da, below about 750 Da, or below about 1000 Da can, in certain embodiments, be used to clarify the tobacco extract according to the invention.

Ultrafiltration and nanofiltration may comprise a cross-flow separation process. The liquid stream to be treated (feed) flows tangentially along the membrane surface, separating into one stream that passes through the membrane (permeate) and another that does not (retentate or concentrate). The operating parameters of the filtration system can be varied to achieve the desired result. For example, the feed mixture to be filtered can be brought into contact with the membrane by way of applied pressure. The rate of permeation across the membrane is directly proportional to the applied pressure; however, the maximum pressure may be limited. The flow velocity of the mixture across the membrane surface can be adjusted. Temperature can also be varied. Typically, permeation rates increase with increasing temperature.

Commercial nanofiltration and ultrafiltration systems are readily available and may be used for the filtration methods of the present invention. For example, commercial suppliers such as Millipore, Spectrum® Labs, Pall Corporation, Whatman®, Porex Corporation, and Snyder Filtration manufacture various filter membranes and cartridges, and/or filtration systems (e.g., tangential flow filtration systems). Exemplary membranes include, but are not limited to, Biomax® and Ultracel® membranes and Pellicon® XL cassettes (from Millipore), Microkros®, Minikros®, and KrosFlo® Hollow Fiber Modules (from Spectrum® Labs), and Microza filters and Centramate™ Centrasette,™ Maximate™, and Maxisette™ Tangential Flow Filtration Membrane Cassettes. Commercially available filtration systems include, but are not limited to, Millipore's Labscale™ Tangential Flow Filtration (TFF) system and Spectrum® Labs' KrosFlo® and MiniKros® Tangential Flow Filtration Systems.

Although ultrafiltration can be used to clarify the extract according to the present invention, it is noted that, in certain embodiments, a more or less rigorous process can be used. In certain embodiments, nanofiltration is used, which may be capable of removing a greater number of compounds (i.e., compounds with lower molecular weights) from a tobacco extract than ultrafiltration.

The tobacco extract can also be subjected to further treatment steps, which can be used in the place of, or in addition to, the distillation and filtration steps described above. For example, in some embodiments, the extract is brought into contact with an imprinted polymer or non-imprinted polymer such as described, for example, in US Pat. Pub. Nos. 2007/0186940 to Bhattacharyya et al; 2011/0041859 to Rees et al.; and 2011/0159160 to Jonsson et al; and U.S. patent application Ser. No. 13/111,330 to Byrd et al., filed May 19, 2011, all of which are incorporated herein by reference. Treatment with a molecularly imprinted or non imprinted polymer can be used to remove certain components of the extract, such as tobacco-specific nitrosamines (TSNAs), including N'-nitrosonornicotine (NNN), (4-methylnitrosamino)-1-(3-pyridyl)-1-butanone (NNK), N'-nitrosoanatabine (NAT), and N'-nitrosoanabasine (NAB); polyaromatic hydrocarbons (PAHs), including benz[a]anthracene, benzo[a]pyrene, benzo[b]fluoranthene, benzo[k]fluoranthene, chrysene, dibenz[a,h]anthracene, and indeno[1,2,3-cd]pyrene; or other Hoffmann analytes. In some embodiments, the extract is clarified and/or concentrated by reverse osmosis.

The clarified tobacco extract (which can be provided, for example, directly from removal of the tobacco extract from the tobacco pulp by filtration and/or distillation, or via filtration or distillation of a separated tobacco extract) generally comprises fewer high molecular weight components than tobacco extract that has not been treated in this way. In certain embodiments, the clarified tobacco extract can be characterized as translucent and/or transparent. As used herein, "translucent" or "translucency" refers to the ability to allow some level of light to travel therethrough diffusely. In certain embodiments, the clarified extract can have such a high degree of clarity that it can be classified as "transparent" or exhibiting "transparency," which is defined as a material allowing light to pass freely through without significant diffusion. The clarity of the clarified extract is generally such that there is some level of translucency as opposed to opacity (which refers to materials that are impenetrable by light).

The improvement in clarity of the clarified extract over a non-clarified extract can be quantified by any known method. For example, optical methods such as turbidimetry (or nephelometry) and colorimetry may be used to quantify the cloudiness (light scattering) and the color (light absorption), respectively, of the clarified tobacco extract. Translucency can also be confirmed by visual inspection by simply holding the clarified extract up to a light source and determining if light travels through the material or product in a diffuse manner. The clarified extract can be stored and/or used in solid form (e.g., spray-dried or freeze-dried form), in liquid form, in semi-solid form, or the like.

In certain embodiments, the clarified extract can be characterized as having a low tobacco-specific nitrosamine content, such as about 150 ng/g or lower based on the weight of the extract. In certain embodiments, the clarified extract can be characterized as having a low benzo[a] pyrene content such as about 1 ng/g or lower based on the weight of the extract.

Tobacco pulp that has been provided and isolated following the extraction step can be whitened in certain embodiments according to any means known in the art, as shown in step 24 of FIG. 2. For example, whitening methods using various bleaching or oxidizing agents and oxidation catalysts can be used. Exemplary oxidizing agents include peroxides (e.g., hydrogen peroxide), chlorite salts, chlorate salts, perchlorate salts, hypochlorite salts, ozone, ammonia, and combinations thereof. Exemplary oxidation catalysts are titanium dioxide, manganese dioxide, and combinations thereof. Processes for treating tobacco with bleaching agents are discussed, for example, in U.S. Pat. No. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 3,943,945 to Rosen; U.S. Pat. No. 4,143,666 to Rainer; U.S. Pat. No. 4,194,514 to Campbell; U.S. Pat. Nos. 4,366,823, 4,366,824, and 4,388,933 to Rainer et al.; U.S. Pat. No. 4,641,667 to Schmekel et al.; and U.S. Pat. No. 5,713,376 to Berger; and PCT WO 96/31255 to Giolvas, all of which are incorporated herein by reference. Other whitening methods using reagents such as ozone and potassium permanganate can also be used. See, for example, U.S. Pat. No. 3,943,940 to Minami, which is incorporated herein by reference.

In certain embodiments of the present invention, tobacco pulp is whitened using a caustic reagent and/or an oxidizing agent. In some embodiments, the tobacco pulp is whitened using both a caustic reagent and an oxidizing agent. In such embodiments, the caustic reagent and oxidizing agent can be provided separately or can be combined.

The caustic reagent can vary and can be, for example, any strong base, including but not limited to, an alkaline metal hydroxide, alkaline earth metal hydroxide, or mixture thereof. In certain exemplary embodiments, the caustic reagent is sodium hydroxide or potassium hydroxide. Alternative reagents that can be used include, but are not limited to, ammonium hydroxide, sodium carbonate, potassium carbonate, ammonia gas, and mixtures thereof. The caustic reagent is generally provided in solution form (e.g., in aqueous solution) and the concentration of the caustic reagent in the solution can vary. Also, the amount of caustic reagent used in the methods of the present invention can vary. For example, in certain embodiments, the caustic reagent is provided in an amount of between about 1% and about 50% dry weight basis (e.g., between about 1% and about 40% or between about 1% and about 30%) by weight of the (dry) tobacco pulp. For example, the caustic reagent can be provided in an amount of about 2%, about 5%, about 7%, about 10%, or about 25% by weight of the (dry) tobacco pulp. It is noted that the quantity of caustic reagent required may, in certain embodiments, vary as a result of the strength of the caustic reagent. For example, more caustic reagent may, in some embodiments, be required where the caustic reagent is a weaker base, whereas less caustic reagent may, in some embodiments, be required where the caustic reagent is a strong base.

The oxidizing agent (i.e., oxidant or oxidizer) can be any substance that readily transfers oxygen atoms and/or gains electrons in a reduction/oxidation (redox) chemical reaction. Peroxides (e.g., hydrogen peroxide) are preferred oxidizing agents; however, any oxidizing reagent, including, but not limited to; other oxides (including nitrous oxide, silver oxide, chromium trioxide, chromate, dichromate, pyridinium chlorochromate; and osmium tetroxide); oxygen ($O_2$); ozone ($O_3$); fluorine ($F_2$); chlorine ($Cl_2$); and other halogens; hypochlorite, chlorite, chlorate, perchlorite, and other halogen analogues thereof; nitric acid; nitrate compounds; sulfuric acid; persulfuric acids; hydroxyl radicals; manganate and permanganate compounds (e.g., potassium permanganate); sodium perborate; 2,2'-diphyridyldisulfide; and combinations thereof can be used according to the invention. In certain preferred embodiments, the oxidizing reagent used according to the invention is chlorine-free. In certain embodiments, the oxidizing reagent is provided in aqueous solution form. The amount of oxidizing agent used in the methods of the present invention can vary. For example, in certain embodiments, the oxidizing agent is provided in a weight amount of about one to fifty times the weight of the (dry) tobacco pulp. For example, in some embodiments, the oxidizing agent is provided in a weight amount about equal to the weight of the (dry) tobacco pulp, about 1.3 times the weight of the (dry) tobacco pulp, about 1.5 times the weight of the (dry) tobacco pulp, about 2 times the weight of the (dry) tobacco pulp, or about 5 times the weight of the (dry) tobacco pulp.

According to the invention, the tobacco pulp is brought into contact with the caustic reagent and/or oxidizing agent for a period of time. The tobacco material can be brought into contact with the caustic reagent and oxidizing reagent simultaneously, or can be brought into contact with the caustic reagent and oxidizing reagent separately. In one embodiment, the oxidizing reagent is added to the tobacco material and then the caustic reagent is added to the tobacco material such that, after addition, both reagents are in contact with the tobacco material simultaneously. In another embodiment, the caustic reagent is added to the tobacco material and then the oxidizing reagent is added to the tobacco material such that, after addition, both reagents are in contact with the tobacco material simultaneously.

The molar ratio of the caustic reagent to oxidizing agent can vary. In certain embodiments where the caustic reagent is NaOH and the oxidizing agent is hydrogen peroxide, the molar ratio of NaOH to hydrogen peroxide is from about 1:1 to about 1:100, preferably from about 1:5 to about 1:50, and more preferably from about 1:10 to about 1:25. In one particular embodiment, the molar ratio of NaOH to hydrogen peroxide is between about 1:20 and about 1:25. These ratios are not limited to ratios of NaOH and hydrogen peroxide and could also be applicable to other caustic reagent and oxidizing agent combinations.

The time for which the tobacco material is contacted with the caustic reagent and/or oxidizing agent can vary. For example, in certain embodiments, the time for which the tobacco material is contacted with the caustic reagent and/or oxidizing agent is that amount of time sufficient to provide a tobacco pulp material with a lightened color as compared to the untreated tobacco material. In certain embodiments, the tobacco material is contacted with the caustic reagent and/or oxidizing agent overnight. Normally, the time period is a period of at least about 10 minutes, typically at least about 20 minutes, more often at least about 30 minutes. In certain embodiments, the time period is a period of no more than about 10 hours, no more than about 8 hours, no more than about 6 hours, no more than about 4 hours, no more than about 2 hours, or no more than about 1 hour.

In certain embodiments, the tobacco material can be heated during treatment with the caustic reagent and/or oxidizing agent. Generally, heating the tobacco material accelerates the whitening process. Where the tobacco material is heated during treatment, sufficient color lightening is typically achieved in less time than in embodiments wherein the tobacco material is unheated during treatment. The temperature and time of the heat treatment process will vary, and generally, the length of the heat treatment will decrease as the temperature of the heat treatment increases. In certain embodiments, the mixture of tobacco material, caustic reagent, and/or oxidizing agent can be heated at a temperature of between room temperature and about 100° C. (e.g., about 90° C. or about 80° C.). Preferably, the mixture is heated between room temperature and about 75° C. The heating, where applicable, can be accomplished using any heating method or apparatus known in the art. The heating can be carried out in an enclosed vessel (e.g., one providing for a controlled atmospheric environment, controlled atmospheric components, and a controlled atmospheric pressure), or in a vessel that is essentially open to ambient air. The temperature can be controlled by using a jacketed vessel, direct steam injection into the tobacco, bubbling hot air through the tobacco, and the like. In certain embodiments, the heating is performed in a vessel also capable of providing mixing of the composition, such as by stirring or agitation. Exemplary mixing vessels include mixers available from Scott Equipment Company, Littleford Day, Inc., Lödige Process Technology, and the Breddo Likwifier Division of American Ingredients Company. Examples of vessels which provide a pressure controlled environment include high pressure autoclaves available from Berghof/America Inc. of Concord, Calif., and high pressure reactors available from The Parr Instrument Co. (e.g., Parr Reactor Model Nos. 4522 and 4552 described in U.S. Pat. No. 4,882,128 to Hukvari et al.). The pressure within the mixing vessel during the process can be atmospheric pressure or elevated pressure (e.g., about 10 psig to about 1,000 psig).

In other embodiments, the heating process is conducted in a microwave oven, a convection oven, or by infrared heating. Atmospheric air, or ambient atmosphere, is the preferred atmosphere for carrying out the optional heating step of the present invention. However, heating can also take place under a controlled atmosphere, such as a generally inert atmosphere. Gases such as nitrogen, argon and carbon dioxide can be used. Alternatively, a hydrocarbon gas (e.g., methane, ethane or butane) or a fluorocarbon gas also can provide at least a portion of a controlled atmosphere in certain embodiments, depending on the choice of treatment conditions and desired reaction products.

Following treatment of the tobacco pulp with the caustic reagent and/or oxidizing reagent, the treated tobacco pulp is generally filtered (i.e., isolated from the caustic reagent and/or oxidizing reagent) and dried to give a whitened tobacco pulp material. In some embodiments, the whitened tobacco pulp thus produced can be characterized as lighened in color (e.g., "whitened") in comparison to the untreated tobacco pulp. Visual and/or instrumental assessments such as those previously described can be used to verify and, if desired, quantify the degree of lightening achieved by way of the presently described method of the invention. Assessment of the whiteness of a material generally requires comparison with another material. The extent of lightening can be quantified, for example, by spectroscopic comparison with an untreated tobacco sample (e.g., untreated tobacco pulp). White colors are often defined with reference to the International Commission on Illumination's (CIE's) chromaticity diagram. The whitened tobacco pulp can, in certain embodiments, be characterized as closer on the chromaticity diagram to pure white than untreated tobacco pulp.

In certain embodiments, the whitened tobacco pulp is combined with a clarified extract as previously described herein (e.g., a filtered extract or distillate). The whitened tobacco pulp and clarified extract can be combined by any means known in the art. For example, the pulp and extract can be combined by any mixing apparatus (e.g., including but not limited to, conical-type blenders, mixing drums, ribbon blenders, or the like). The relative amounts of the whitened tobacco pulp and clarified extract in the combined whitened tobacco material can vary. For example, in certain embodiments, the weight ratio of whitened pulp to tobacco extract is between about 90:1 and about 1:1. The amount of clarified extract can vary, for example, because the nature (e.g., the water content and the nicotine content) of the extract can vary. In certain embodiments, the nature of the extract is dependent on the method of extract clarification used. For example, more extract may be used in embodiments wherein the extract is clarified by filtration, whereas less extract may be used in embodiments wherein the extract is clarified by distillation. In certain embodiments, the weight ratio (by dry weight basis) of whitened pulp to filtered tobacco extract is between about 1:1 and about 10:1 (e.g., between about 1.5:1 and about 3:1). In certain embodiments, the weight ratio of whitened pulp to distilled tobacco extract is between about 10:1 and about 90:1. In some embodiments, the amount of extract is adjusted so as to achieve a desired amount of certain tobacco components and/or a desired amount of moisture content in the final product.

Although it is advantageous to derive the whitened tobacco pulp and clarified tobacco extract (or the whitened tobacco pulp and distillate) from the same tobacco material, it is possible in certain embodiments to combine whitened tobacco pulp and clarified extract (or distillate) derived from separate tobacco materials within a combined whitened tobacco material.

The tobacco materials discussed in the present invention can be treated and/or processed in other ways before, after, or during the whitening, clarification, and/or combining steps. For example, if desired, the tobacco materials can be irradiated, pasteurized, or otherwise subjected to controlled heat treatment. Such treatment processes are detailed, for example, in US Pat. Pub. No. 2009/0025738 to Mua et al., which is incorporated herein by reference. In certain embodiments, tobacco materials can be treated with water and an additive capable of inhibiting reaction of asparagine to form acrylamide upon heating of the tobacco material (e.g., an additive selected from the group consisting of lysine, glycine, histidine, alanine, methionine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof), and combinations thereof. See, for example, the types of treatment processes described in US Pat. Pub. Nos. 2010/0300463 and 2011/0048434 to Chen et al., and U.S. patent application Ser. No. 13/228,912, filed Sep. 9, 2011, which are all incorporated herein by reference. In certain embodiments, this type of treatment is useful where the original tobacco material is subjected to heat in the extraction and/or distillation process previously described.

The combined whitened tobacco material can be incorporated within a smokeless tobacco product according to the present invention. Although the present application focuses on the use of combined whitened tobacco material comprising a whitened tobacco pulp and a clarified tobacco extract, it is noted that, in certain embodiments, a whitened tobacco pulp and/or a clarified tobacco extract prepared according to the methods disclosed herein can be separately included within a smokeless tobacco product. Depending on the type of tobacco product being processed, the tobacco product can include one or more additional components in addition to the combined whitened tobacco material as described above. For example, the combined whitened tobacco material can be processed, blended, formulated, combined and/or mixed with other materials or ingredients, such as other tobacco materials or flavorants, fillers, binders, pH adjusters, buffering agents, salts, sweeteners, colorants, oral care additives, disintegration aids, antioxidants, humectants, and preservatives. See, for example, those representative components, combination of components, relative amounts of those components and ingredients relative to tobacco, and manners and methods for employing those components, set forth in US Pat. Pub. Nos. 2011/0315154 to Mua et al. and 2007/0062549 to Holton, Jr. et al. and U.S. Pat. No. 7,861,728 to Holton, Jr. et al., each of which is incorporated herein by reference.

The relative amount of combined whitened tobacco material within the smokeless tobacco product may vary. Preferably, the amount of combined whitened tobacco material within the smokeless tobacco product is at least about 10%, at least about 25%, at least about 50%, at least about 60%, at least about 70%, at least about 80%, or at least about 90% on a dry weight basis of the formulation. A typical range of tobacco material within the formulation is about 10 to about 99%, more often about 50 to about 99% by weight on a dry basis. For example, the combined whitened tobacco material may, in certain embodiments, comprise whitened pulp in an amount of from about 50% to about 95% based on dry weight basis of the formulation. Further, the combined whitened tobacco material may, in certain embodiments, comprise clarified tobacco extract in an amount of from about 1% to about 3% (distilled extract) based on dry weight basis of the formulation or in an amount of from about 20% to about 40% (filtered extract).

The combined whitened tobacco material used for the manufacture of the smokeless tobacco products of the invention preferably is provided in a ground, granulated, fine particulate, or powdered form. Although not strictly necessary, the combined whitened tobacco material may be subjected to processing steps that provide a further grinding for further particle size reduction. The whitening processes of the present invention generally provide a combined whitened tobacco material with a decreased amount of high molecular weight compounds, leading to more interstitial room and thus higher possible water content in smokeless tobacco materials produced therefrom than those from unwhitened tobacco materials. In certain embodiments, the smokeless tobacco products produced according to the invention provide for faster nicotine release than products produced from unwhitened tobacco materials.

Exemplary flavorants that can be used are components, or suitable combinations of those components, that act to alter the bitterness, sweetness, sourness, or saltiness of the smokeless tobacco product, enhance the perceived dryness or moistness of the formulation, or the degree of tobacco taste exhibited by the formulation. Flavorants may be natural or synthetic, and the character of the flavors imparted thereby may be described, without limitation, as fresh, sweet, herbal, confectionary, floral, fruity, or spicy. Specific types of flavors include, but are not limited to, vanilla, coffee, chocolate/cocoa, cream, mint, spearmint, menthol, peppermint, wintergreen, *eucalyptus*, lavender, cardamon, nutmeg, cinnamon, clove, cascarilla, sandalwood, honey, jasmine, ginger, anise, sage, licorice, lemon, orange, apple, peach, lime, cherry, strawberry, and any combinations thereof. See also, Leffingwell et al., Tobacco Flavoring for Smoking Products, R. J. Reynolds Tobacco Company (1972), which is incorporated herein by reference. Flavorings also may include components that are considered moistening, cooling or smoothening agents, such as *eucalyptus*. These flavors may be provided neat (i.e., alone) or in a composite (e.g., spearmint and menthol, or orange and cinnamon). Representative types of components also are set forth in U.S. Pat. No. 5,387,416 to White et al.; US Pat. App. Pub. No. 2005/0244521 to Strickland et al.; and PCT Application Pub. No. WO 05/041699 to Quinter et al., each of which is incorporated herein by reference. Types of flavorants include salts (e.g., sodium chloride, potassium chloride, sodium citrate, potassium citrate, sodium acetate, potassium acetate, and the like), natural sweeteners (e.g., fructose, sucrose, glucose, maltose, mannose, galactose, lactose, and the like), artificial sweeteners (e.g., sucralose, saccharin, aspartame, acesulfame K, neotame, and the like); and mixtures thereof. The amount of flavorants utilized in the tobacco composition can vary, but is typically up to about 10 dry weight percent, and certain embodiments are characterized by a flavorant content of at least about 1 dry weight percent, such as about 1 to about 10 dry weight percent. Combinations of flavorants are often used, such as about 0.1 to about 2 dry weight percent of an artificial sweetener, about 0.5 to about 8 dry weight percent of a salt such as sodium chloride and about 1 to about 5 dry weight percent of an additional flavoring.

Exemplary filler materials include vegetable fiber materials such as sugar beet fiber materials (e.g., FIBREX® brand filler available from International Fiber Corporation), oats or other cereal grain (including processed or puffed grains), bran fibers, starch, or other modified or natural cellulosic materials such as microcrystalline cellulose. Additional specific examples include corn starch, maltodextrin, dextrose, calcium carbonate, calcium phosphate, lactose, manitol, xylitol, and sorbitol. The amount of filler, where utilized in the tobacco composition, can vary, but is typically up to about 20 dry weight percent, and certain embodiments are characterized by a filler content of up to about 10 dry weight percent, up to about 5 dry weight percent or up to about 1 dry weight percent. Combinations of fillers can also be used.

Typical binders can be organic or inorganic, or a combination thereof. Representative binders include povidone, sodium carboxymethylcellulose and other modified cellulosic materials, sodium alginate, xanthan gum, starch-based binders, gum arabic, pectin, carrageenan, pullulan, zein, and the like. The amount of binder utilized in the tobacco composition can vary, but is typically up to about 30 dry weight percent, and certain embodiments are characterized by a binder content of at least about 5 dry weight percent, such as about 5 to about 30 dry weight percent.

Preferred pH adjusters or buffering agents provide and/or buffer within a pH range of about 6 to about 10, and exemplary agents include metal hydroxides, metal carbonates, metal bicarbonates, and mixtures thereof. Specific exemplary materials include citric acid, sodium hydroxide, potassium hydroxide, potassium carbonate, sodium carbonate, and sodium bicarbonate. The amount of pH adjuster or buffering material utilized in the tobacco composition can vary, but is typically up to about 5 dry weight percent, and certain embodiments can be characterized by a pH adjuster/buffer content of less than about 0.5 dry weight percent, such as about 0.05 to about 0.2 dry weight percent. Particularly in embodiments comprising an extract clarified by distillation, the pH may be lowered by the addition of one or more pH adjusters (e.g., citric acid).

A colorant may be employed in amounts sufficient to provide the desired physical attributes to the tobacco formulation. Exemplary colorants include various dyes and pigments, such as caramel coloring and titanium dioxide. The amount of colorant utilized in the tobacco composition can vary, but is typically up to about 3 dry weight percent, and certain embodiments are characterized by a colorant content of at least about 0.1 dry weight percent, such as about 0.5 to about 3 dry weight percent.

Exemplary humectants include glycerin and propylene glycol. The amount of humectant utilized in the tobacco composition can vary, but is typically up to about 5 dry weight percent, and certain embodiments can be characterized by a humectant content of at least about 1 dry weight percent, such as about 2 to about 5 dry weight percent.

Other ingredients such as preservatives (e.g., potassium sorbate), disintegration aids (e.g., microcrystalline cellulose, croscarmellose sodium, crospovidone, sodium starch glycolate, pregelatinized corn starch, and the like), and/or antioxidants can also be used. Typically, such ingredients, where used, are used in amounts of up to about 10 dry weight percent and usually at least about 0.1 dry weight percent, such as about 0.5 to about 10 dry weight percent. A disintegration aid is generally employed in an amount sufficient to provide control of desired physical attributes of the tobacco formulation such as, for example, by providing loss of physical integrity and dispersion of the various component materials upon contact of the formulation with water (e.g., by undergoing swelling upon contact with water).

As noted, in some embodiments, any of the components described above can be added in an encapsulated form (e.g., in the form of microcapsules), the encapsulated form a wall or barrier structure defining an inner region and isolating the inner region permanently or temporarily from the tobacco composition. The inner region includes a payload of an additive either adapted for enhancing one or more sensory characteristics of the smokeless tobacco product, such as taste, mouthfeel, moistness, coolness/heat, and/or fragrance, or adapted for adding an additional functional quality to the smokeless tobacco product, such as addition of an antioxidant or immune system enhancing function. See, for example, the subject matter of US Pat. Appl. Pub. No. 2009/0025738 to Mua et al., which is incorporated herein by reference.

Representative tobacco formulations may incorporate about 80% to about 95% percent combined whitened tobacco material, about 0.1% to about 5% artificial sweetener, about 0.5% to about 2% salt, about 1% to about 5% flavoring, about 1% to about 5% humectants (e.g., propylene glycol), and up to about 10% pH adjuster or buffering agent (e.g., sodium bicarbonate or citric acid), based on the total dry weight of the tobacco formulation. The particular percentages and choice of ingredients will vary depending upon the desired flavor, texture, and other characteristics.

The components of the tobacco composition can be brought together in admixture using any mixing technique or equipment known in the art. The optional components noted above, which may be in liquid or dry solid form, can be admixed with the combined whitened tobacco material in a pretreatment step prior to mixture with any remaining components of the composition or simply mixed with the combined whitened tobacco material together with all other liquid or dry ingredients. Any mixing method that brings the tobacco composition ingredients into intimate contact can be used. A mixing apparatus featuring an impeller or other structure capable of agitation is typically used. Exemplary mixing equipment includes casing drums, conditioning cylinders or drums, liquid spray apparatus, conical-type blenders, ribbon blenders, mixers available as FKM130, FKM600, FKM1200, FKM2000 and FKM3000 from Littleford Day, Inc., Plough Share types of mixer cylinders, and the like. As such, the overall mixture of various components with the whitened tobacco material may be relatively uniform in nature. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. Manners and methods for formulating snus-type tobacco formulations will be apparent to those skilled in the art of snus tobacco product production.

The moisture content of the smokeless tobacco product prior to use by a consumer of the formulation may vary. Typically, the moisture content of the product, as present within the pouch prior to insertion into the mouth of the user, is less than about 55 weight percent, generally is less than about 50 weight percent, and often is less than about 45 weight percent. For certain tobacco products, such as those incorporating snus-types of tobacco compositions, the moisture content may exceed 20 weight percent, and often may exceed 30 weight percent. For example, a representative snus-type product may possess a tobacco composition exhibiting a moisture content of about 20 weight percent to about 50 weight percent, preferably about 20 weight percent to about 40 weight percent.

The manner by which the moisture content of the formulation is controlled may vary. For example, the formulation may be subjected to thermal or convection heating. As a specific example, the formulation may be oven-dried, in warmed air at temperatures of about 40° C. to about 95° C., with a preferred temperature range of about 60° C. to about 80° C. for a length of time appropriate to attain the desired moisture content. Alternatively, tobacco formulations may be moistened using casing drums, conditioning cylinders or drums, liquid spray apparatus, ribbon blenders, or mixers. Most preferably, moist tobacco formulations, such as the types of tobacco formulations employed within snus types of products, are subjected to pasteurization or fermentation. Techniques for pasteurizing/heat treating and/or fermenting snus types of tobacco products will be apparent to those skilled in the art of snus product design and manufacture.

The acidity or alkalinity of the tobacco formulation, which is often characterized in terms of pH, can vary. Typically, the pH of that formulation is at least about 6.5, and preferably at least about 7.5. Typically, the pH of that formulation will not exceed about 9, and often will not exceed about 8.5. A representative tobacco formulation exhibits a pH of about 6.8 to about 8.2 (e.g., about 7.8). A representative technique for determining the pH of a tobacco formulation involves dispersing 5 g of that formulation in 100 ml of high performance liquid chromatography water, and measuring the pH of the resulting suspension/solution (e.g., with a pH meter).

In certain embodiments, the combined whitened tobacco material and any other components noted above are combined within a moisture-permeable packet or pouch that acts as a container for use of the tobacco. The composition/construction of such packets or pouches, such as the container pouch 12 in the embodiment illustrated in FIG. 1, may be varied. Suitable packets, pouches or containers of the type used for the manufacture of smokeless tobacco products are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. The tobacco formulation may be contained in pouches and packaged, in a manner and using the types of components used for the manufacture of conventional snus types of products. The pouch provides a liquid-permeable container of a type that may be considered to be similar in character to the mesh-like type of material that is used for the construction of a tea bag. Components of the loosely arranged, granular tobacco formulation readily diffuse through the pouch and into the mouth of the user.

Descriptions of various components of snus types of products and components thereof also are set forth in US Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and US Pat. Pub. No. 2005/0061339 to Hansson et al.; each of which is incorporated herein by reference. See, also, the types of pouches set forth in U.S. Pat. No. 5,167,244 to Kjerstad, which is incorporated herein by reference. Snus types of products can be manufactured using equipment such as that available as SB 51-1/T, SBL 50 and SB 53-2/T from Merz Verpackungmaschinen GmbH. Snus pouches can be provided as individual pouches, or a plurality of pouches (e.g., 2, 4, 5, 10, 12, 15, 20, 25 or 30 pouches) can connected or linked together (e.g., in an end-to-end manner) such that a single pouch or individual portion can be readily removed for use from a one-piece strand or matrix of pouches.

An exemplary pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other exemplary pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material.

The amount of material contained within each pouch may vary. In smaller embodiments, the dry weight of the material within each pouch is at least about 50 mg to about 150 mg. For a larger embodiment, the dry weight of the material within each pouch preferably does not exceed about 300 mg to about 500 mg. In some embodiments, each pouch/container may have disposed therein a flavor agent member, as described in greater detail in U.S. Pat. No. 7,861,728 to Holton, Jr. et al., which is incorporated herein by reference. If desired, other components can be contained within each pouch. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

The smokeless tobacco product can be packaged within any suitable inner packaging material and/or outer container. See also, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; D592,956 to Thiellier; D594,154 to Patel et al.; and D625,178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; 2010/0264157 to Bailey et al.; 2011/0168712 to Bailey et al.; and 2011/0204074 to Gelardi et al., which are incorporated herein by reference.

Products of the present invention may be packaged and stored in much the same manner that conventional types of smokeless tobacco products are packaged and stored. For example, a plurality of packets or pouches may be contained in a cylindrical container. If desired, moist tobacco products (e.g., products having moisture contents of more than about 20 weight percent) may be refrigerated (e.g., at a temperature of less than about 10° C., often less than about 8° C., and sometimes less than about 5° C.). Alternatively, relatively dry tobacco products (e.g., products having moisture contents of less than about 15 weight percent) often may be stored under a relatively wide range of temperatures.

The smokeless tobacco products of the invention are advantageous in that they provide a composition that is non-staining, or is staining to a lesser degree than products comprising only unwhitened tobacco materials. These products thus are desirable in reducing staining of teeth and clothing that may come in contact therewith. It is noted that even the spent (used) product is lighter in color than traditional spent (used) oral tobacco products. Further, the products may have enhanced visual appeal by virtue of their whitened color.

The following examples are provided to illustrate further the present invention, but should not be construed as limiting the scope thereof. Unless otherwise noted, all parts and percentages are by weight.

EXPERIMENTAL

The present invention is more fully illustrated by the following examples, which are set forth to illustrate the present invention and are not to be construed as limiting thereof. In the following examples, g means gram, L means liter, mL means milliliter, and Da means daltons. All weight percentages are expressed on a dry basis, meaning excluding water content, unless otherwise indicated.

Example 1

Preparation of Whitened Stem Tobacco Pulp

Seven lamina grades and four stem grades are visually evaluated to determine which material is lightest in color. The lightest color stem grade (*Rustica*) is brought into contact with hot water (eight parts hot water to one part of milled stem) for about one hour. The resulting material is filtered to give a tobacco pulp and a first tobacco extract. This process is repeated to give a tobacco pulp and a second tobacco extract. The second extract is discarded.

The tobacco pulp is then brought into contact with an aqueous solution comprising 5% NaOH for about one hour (400 g 5% NaOH solution (containing 20 g NaOH and corresponding to 0.27 parts solution per 1 part washed pulp on dry basis weight). The resulting material is filtered to give a tobacco pulp, which is washed two more times and dried to about 20% moisture. The water solubles are discarded.

To the resulting 50 g of wet solid tobacco pulp (9.25 dry weight basis) is added 2.31 g NaOH in 75 g DI water and 12.12 g (wet weight) of 30% $H_2O_2$ solution. The mixture is stirred in an open vessel. In certain examples, the weight of NaOH added is about 25% of the weight of the washed tobacco pulp on a dry weight basis, with NaOH solution water in an amount of about 8.1 times the amount of the washed tobacco pulp and the weight of $H_2O_2$ added is about 1.31 parts to 1 part washed pulp on a dry weight basis. The mixture is allowed to soak overnight. The treated pulp is filtered and washed with 8 parts hot water to 1 part pulp, soaked for an hour, and filtered. This washing step is repeated and the whitened pulp is filtered and dried in a Littleford Batch Processor with heated jacket and airflow to 20% moisture.

Example 2

Preparation of Clarified (Filtered) Tobacco Extract

A clarified (filtered) extract is provided by taking the first tobacco extract from Example 1 and passing the extract through one or more filters. The extract is passed through a combination of filters and/or ultrafiltration membranes, such as any filters or membranes with pore sizes of 50,000 Da, 5000 Da, 1000 Da, 750 Da and/or 250 Da. For example, the extract can be passed through only a 1000 Da filter. The clarified extract is then concentrated via reverse osmosis or evaporation.

Example 3

Preparation of Clarified (Distilled) Extract

A clarified (distilled) extract is provided by taking the first tobacco extract (500 g, comprising 4% solids) from Example 1 and NaOH or potassium hydroxide ("KOH") is added in an amount of about 10 percent the amount of tobacco solids by weight (e.g., 2 g of NaOH or KOH). Alternatively, NaOH and KOH can be used in an amount of about 15% the amount of tobacco solids by weight (e.g., about 3 g combined NaOH and KOH). Alternatively, a solution comprising 10% NaOH and 10% sodium bicarbonate buffer can be added. The mixture is vented to a condenser and heated with a jacket temperature of about 230° F. (110° C.) for about an hour in a steam distillation process. A distillate is collected in the condenser at room temperature, to give about 250 mL of a clarified extract (i.e., distillate). The distillate comprises around 0.15% to about 0.25% nicotine and is concentrated.

Example 4

Preparation of Combined Whitened Tobacco Material

The clarified extract of Example 2 is combined with the whitened tobacco pulp of Example 1 to give a combined whitened tobacco material. The combined whitened tobacco material can be incorporated within a smokeless tobacco product.

Specifically, an exemplary smokeless tobacco product is prepared that comprises washed pulp (55.7% dry weight basis, having 20% moisture), filtered extract (28.0% dry weight basis, having 92.54% moisture), salt (1.3% dry weight basis, having 0.01% moisture), sodium bicarbonate (8.0% dry weight basis, having 0.01% moisture), artificial sweetener (1.5% dry weight basis, having 0.01% moisture), propylene glycol (3.5% dry weight basis, having 0.01% moisture), and flavoring (2% dry weight basis, having 0.01% moisture).

Example 5

Preparation of Combined Whitened Tobacco Material

The distillate of Example 3 is combined with the whitened tobacco pulp of Example 1 to give a combined whitened tobacco material. The combined whitened tobacco material can be incorporated within a smokeless tobacco product.

Specifically, an exemplary smokeless tobacco product is prepared that comprises washed pulp (91.1% dry weight basis, having 20% moisture), distilled extract (1.5% dry weight basis, having 98.5% moisture), salt (1.3% dry weight basis, having 0.01% moisture), sodium bicarbonate (8.0% dry weight basis, having 0.01% moisture), citric acid (0.1% dry weight basis, having 0.01% moisture), artificial sweetener (0.5% dry weight basis, having 0.01% moisture), propylene glycol (3.5% dry weight basis, having 0.01% moisture), and flavoring (2% dry weight basis, having 0.01% moisture).

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A tobacco product comprising a water-permeable pouch containing a whitened tobacco composition, the whitened tobacco composition comprising a translucent tobacco extract carried by a whitened tobacco pulp, wherein the whitened tobacco composition is in a ground, granulated, fine particulate, or powdered form.

2. The tobacco product of claim 1, wherein the translucent tobacco extract is in the form of a distillate or a filtered tobacco extract.

3. The tobacco product of claim 1, wherein the translucent tobacco extract is characterized by a low tobacco-specific nitrosamine content of about 150 ng/g or less.

4. The tobacco product of claim 1, wherein the translucent tobacco extract is characterized by a low benzo[a]pyrene content of about 1 ng/g tobacco extract or less.

5. The tobacco product of claim 1, wherein the translucent tobacco extract does not comprise any components having a molecular weight greater than about 1000 Da.

6. The tobacco product of claim 1, further comprising one or more additional components selected from the group consisting of flavorants, fillers, binders, pH adjusters, buffering agents, colorants, disintegration aids, antioxidants, humectants, and preservatives.

7. The tobacco product of claim 1, comprising about 80% to about 95% whitened tobacco composition; about 0.1% to about 5% artificial sweetener; about 0.5% to about 2% salt; about 1% to about 5% flavoring; and about 1% to about 5% humectant.

8. The tobacco product of claim 7, wherein the humectant comprises propylene glycol.

9. The tobacco product of claim 1, wherein the whitened tobacco pulp and the translucent tobacco extract are present in a weight ratio of about 1:1 to about 10:1.

10. The tobacco product of claim 1, wherein the whitened tobacco pulp and the translucent tobacco extract are present in a weight ratio of about 1.5:1 to about 3:1.

11. The tobacco product of claim 1, wherein the whitened tobacco pulp comprises a pulp of tobacco lamina, or a tobacco lamina and stem mixture.

12. A method of preparing the tobacco product of claim 1, comprising: (i) extracting a tobacco material with an aqueous solution to give a tobacco pulp and a tobacco extract; (ii) treating the tobacco pulp with at least one of a caustic reagent and an oxidizing agent for a time and at a temperature sufficient to lighten the color of the tobacco pulp to give a whitened tobacco pulp; (iii) clarifying the tobacco extract to give a translucent tobacco extract; (iv) combining the whitened tobacco pulp with the translucent tobacco extract to form a whitened tobacco material in ground, granulated, fine particulate, or powdered form; and (v) incorporating a whitened tobacco composition comprising the whitened tobacco material within the water-permeable pouch.

13. The method of claim 12, wherein the whitened tobacco pulp and clarified tobacco extract combined in step (iv) are derived from the same tobacco material.

14. The method of claim 12, wherein the whitened tobacco pulp and clarified tobacco extract combined in step (iv) are derived from different tobacco materials.

15. The method of claim 12, wherein the caustic reagent is sodium hydroxide.

16. The method of claim 12, wherein the oxidizing agent is hydrogen peroxide.

17. The method of claim 12, wherein the molar ratio of the amount of caustic reagent to oxidizing agent is from about 1:1 to about 1:100.

18. The method of claim 12, further comprising selecting the tobacco material to be extracted in step (i) by visually inspecting a group of tobacco materials and selecting the tobacco material that is relatively light in color as compared with the remainder of the tobacco materials in the group.

19. The method of claim 12, wherein the treating step further comprises heating the mixture of tobacco pulp, caustic reagent, and oxidizing agent at a temperature sufficient to increase the rate of whitening.

20. The method of claim 12, wherein the clarifying step comprises distilling or filtering the tobacco extract.

21. The method of claim 20, wherein said filtering comprises passing the tobacco extract through a membrane filter having a cutoff molecular weight of 1000 Da.

* * * * *